US005079712A

United States Patent [19]

Ileana et al.

[11] Patent Number: 5,079,712

[45] Date of Patent: Jan. 7, 1992

[54] REGISTER SETTING ARRANGEMENT FOR CARRIER MANAGEMENT SYSTEM

[75] Inventors: D. Barnes Ileana, Wilton; Nancy G. Bonn, Easton; Richard E. Dinnis, Stratford; Alonzo T. Dukes, Bridgeport, all of Conn.; Michael T. Powers, Sudbury, Mass.; David J. Taylor, Norwalk, Conn.

[73] Assignee: Pitney Bowes Inc., Stamford, Conn.

[21] Appl. No.: 487,090

[22] Filed: Mar. 2, 1990

[51] Int. Cl.[5] ..... G07B 17/02

[52] U.S. Cl. ..... 364/464.03; 364/464.02

[58] Field of Search ..... 364/464.02, 464.03

[56] References Cited

U.S. PATENT DOCUMENTS

| | | | |
|---|---|---|---|
| 4,325,440 | 4/1982 | Crowley et al. | 177/25.15 |
| 4,393,454 | 7/1983 | Soderberg | 364/518 |
| 4,420,819 | 12/1983 | Price et al. | 364/900 |
| 4,495,581 | 1/1985 | Piccione | 364/464.03 |
| 4,509,141 | 4/1985 | Soderberg et al. | 364/464.02 X |
| 4,595,984 | 6/1986 | Daniels | 364/466 |
| 4,713,761 | 12/1987 | Sharpe et al. | 364/406 |
| 4,821,195 | 4/1989 | Baer et al. | 364/464.02 |
| 4,839,813 | 6/1989 | Hills et al. | 364/464.03 |
| 4,872,119 | 10/1989 | Kajimoto | 364/464.03 |

*Primary Examiner*—Parshotam S. Lall
*Assistant Examiner*—Edward R. Cosimano
*Attorney, Agent, or Firm*—Nathaniel Levin; Melvin J. Scolonick; Robert H. Whisker

[57] ABSTRACT

A carrier management system includes accounting registers, and a program for setting the registers. The program may be responsive to the input of coded values for decoding these values and storing them in the registers. The program may be enabled, for a single operation, by insertion of a service PROM in the system.

9 Claims, 6 Drawing Sheets

REGISTER SETTING ARRANGEMENT FOR CARRIER MANAGEMENT SYSTEM

FIELD OF THE INVENTION

This invention relates to carrier management systems for expediting the shipment of parcels via one or more carriers and/or classes, and is more in particular directed to the provision of a secure arrangement for setting of one or more accounting registers in a system of this type.

BACKGROUND OF THE INVENTION

In the shipping of parcels, it is frequently desirable to make provision for shipping by more than one carrier. In current shipping practice, provision must be made for the shipping of parcels by two major carriers, such as the United States Postal System (USPS) and the United Parcel Service (UPS), a private carrier, as well as any of a large number of smaller private carriers. In prior tracking or recording systems, various data concerning parcels or groups of parcels to be shipped were entered by an operator, so that the information could be stored in the records of a memory. The "transactions" recorded included information relating to the shipment, such as, for example, the identification of the carrier, the number of packages in the shipment, the weight, address data, charges, date and time, invoice number, etc. Factors such as weight were entered either manually or automatically by a scale, while other factors such as zip code were generally entered by an operator by way of a keyboard. Such systems contemplated the provision in the programs of routines that determined shipping costs on the basis of the information that was input.

Systems of this type are disclosed, for example, in U.S. Pat. Nos. 4,325,440; 4,495,581 and 4,595,984.

SUMMARY OF THE INVENTION

In accordance with the invention, a carrier management system of the above type in provided with accounting registers, in order to enable the secure accounting of transactions recorded by the system. The invention is specifically directed to the provision of a secure arrangement enabling the setting or resetting of such registers.

Briefly stated, the invention provides a carrier management system including a scale for weighing parcels to be shipped, a computer connected to receive data from the scale related to the weight of a parcel thereon, and a keyboard enabling operator input to the computer. The computer comprises an accounting register, and has a program for resetting the register. The system further comprises service memory means, means for releasably coupling the service memory means to the system, and means responsive to coupling of the service memory to the system for enabling the resetting program for a single operation of the resetting program.

The program preferrably comprises means for receiving encoded values from the keyboard and means for decoding the encoded values for storing in the register. The system may include printing means connected to the computer for printing the encoded values.

In accordance with a further feature of the invention, a carrier management system includes a scale for weighing parcels to be shipped and determining shipping costs thereof, a computer connected to receive data from the scale related to the weight of a parcel thereon, a keyboard enabling operator input to the computer, and printing means. The printing means is coupled to the computer, and the process of weighing a parcel and determining the shipping costs thereof comprises a transaction. In accordance with the invention, the computer has a memory with a register for 45 storing accounting data related to the shipping of parcels, and a program for resetting the register. The program is responsive to coded values input into the keyboard for decoding the coded values for resetting the register. The computer further comprises means for actuating the printing means for printing the coded value for every transaction.

The service memory means may comprise a PROM releasably coupled to the system. The PROM may be mounted under a platform of the scale.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
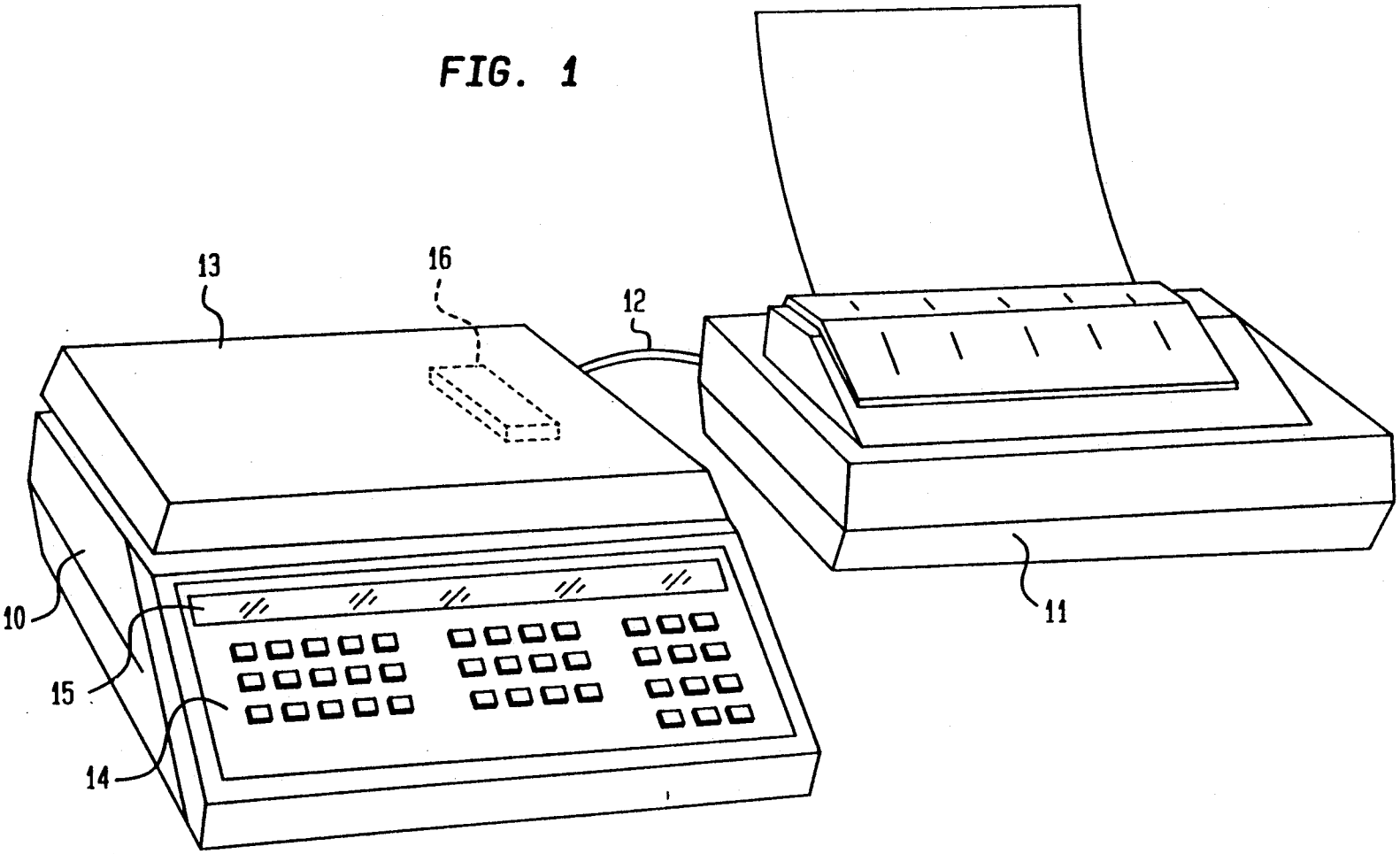
FIG. 1 is a perspective illustration of a carrier management system that may incorporate the present invention.

Referring now to the drawings, FIG. 1 is a perspective view of a carrier management system that may be employed in the present invention, including a console 10 and an optional printer 11 coupled thereto via cable 12. The console supports a platform 13 for receiving parcels to be weighed. The front panel of the console includes a keyboard 14 and a display 15. A replaceable board 16, illustrated in dashed lines, is mounted on or in the console below the platform, this board 16 having one or more ROM's or PROM's thereon. These ROM's store data that may be unique to the user of the system, and are replaceable by other ROM boards in order, for example, to enable a serviceman to gain access to critical setup programs stored in other NVM in the console.

Figure 2:
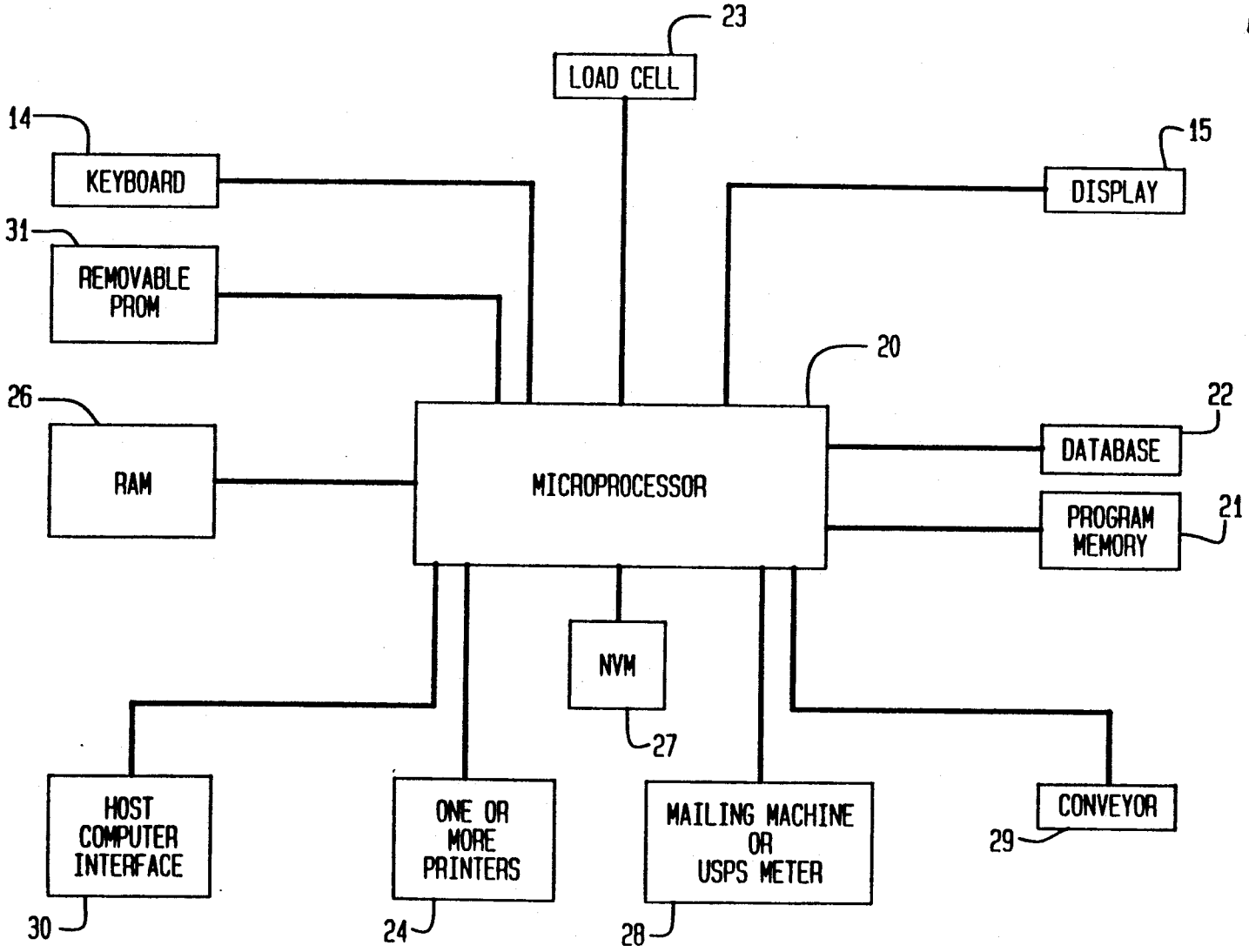
FIG. 2 is a block diagram of the system of FIG. 1.

FIG. 2 is a block diagram of the carrier management system of FIG. 1. The system incorporates a microcomputer including a microprocessor 20 having a nonvolatile program memory 21 containing the program for operation of the system, and a nonvolatile database memory 22 having stored therein rate information of all carriers for which the system is expected to determine cost data. This latter memory is preferably replaceable in order to be able to update rate information, change or add carriers and/or classes of service, etc. A load cell 23 coupled to the platform applies data to the microprocessor related to the weight of a parcel on the platform.

The system further includes one or more printers 24, one of which may be the printer 11 illustrated in FIG. 1, and another of which may be internal to the system, if desired. The system may have a battery backed up RAM 26 (i.e. non-volatile) that defines a working accounting register, an $E^2$ ROM 27 (electrically programmable ROM), and further NVM memory 35, and may be adapted to be connected to a mailing machine or USPS meter 28, a conveyor 29, and/or a host computer interface 30. It is of course apparent that the various non-volatile memories may be of a different type than above discussed.

In addition, the system includes a further removable "user" ROM or PROM 31, (e.g. which may be on the board 16 illustrated in FIG. 1), as will be discussed. A "service" PROM 36 is also adapted to be removably coupled to the system, as will also be discussed.

The system in accordance with the invention is adapted to determine mailing or shipping charges for a parcel placed on the platform 13, and may be adapted to print a manifest, label, tag, etc. related the shipping of the parcel, and/or it may include internal registers for accounting for the shipping of such parcels.

Figure 3:
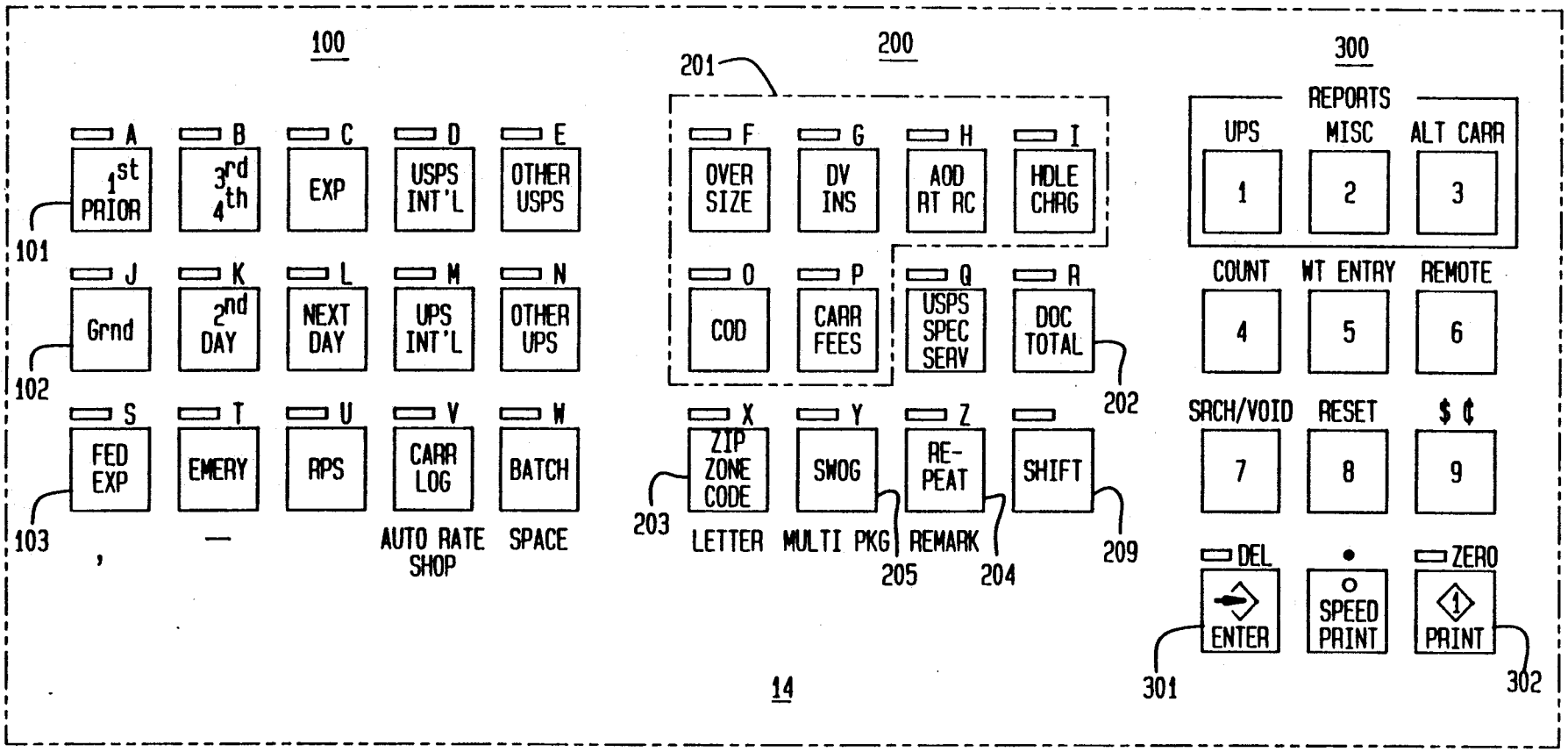
FIG. 3 is an illustration of the keyboard of the system of FIG. 1.

Referring now to FIG. 3, therein is illustrated the keyboard 14 of a preferred carrier management shipping system in accordance with the invention. The keyboard includes three sets 100, 200, 300 of keys. Each of the keys has a label printed thereon corresponding to the primary function of the key. Secondary and tertiary functions are printed above and below the keys showing additional functions that depression of the associated the keys may enable.

The group 100 of keys includes three rows 101, 102, 103 of keys, each row having five keys. These keys are known as the carrier/class keys, since their primary function is concerned with the selection of the carrier to use for shipping a given parcel, or the class of shipment that is to be employed for the shipment. For example, the keys of the first row 101 may be concerned with shipments by the USPS, and depression of any of these keys automatically selects shipping via USPS, with the specific class being determined by the key in the row that is depressed. Thus, depression of the first key in the row indicates that calculations should be made on the basis of first class or priority class mailing. These calculations are based upon the weight of the parcel. If priority class is to be selected, by the depression of this key, a response will be made to a later prompt for an input of the zip or zone. of destination. Similarly, depression of the second key selects third or fourth class mail, depression of third key selects express mail, depression of the fourth key selects USPS international mail, and depression of the fifth key in the row selects other classes, the specific selection of other classes being in response to prompts on the display.

Depression of a key of the second row 102 of keys automatically selects UPS as the carrier, with the various keys of this row hence being directed to various classes of shipping via UPS.

The fourth key in the row 103 enables the user to select infrequently used carriers and/or classes from a menu that appears on the display. Such selection may require the user to calculate the shipping charges, since the rates for these carriers and/or classes may not be stored in the system.

Selection of the last key in the row 103 enables the user to process a group of parcels as a single transaction.

The second group 200 of keys includes a group 201 of toggle keys enabling the user to select or deselect special services. These keys may include, for example, a key for oversize parcels to require shipping charge determination to be also based upon the size of the parcel, a key requiring addition of insurance charges, a key including charges for a return receipt, a key for COD shipments, a key to call a menu for special services for alternate carriers, etc.

In addition, this group 200 of keys includes a key 202 to effect printing of accumulated values for a group of parcels, a key 203 to change the zip or zone identification, a key 204 to repeat the data of the previous transaction and a key 205 to process the parcel for shipment with other goods. In addition, the group 200 includes the SHIFT key 209 which enables selection of second and third functions of various ones of the other keys.

The third group 300 of keys enables numeric entry by the user, in response to prompts for such entries from the display, and also includes an ENTER key 301 for enabling entering of certain responses, and a PRINT key 302 for causing the printing of the manifest, label, tape, and/or the entering of data into internal registers, etc.

Most of the keys also have a second function printed above the key, the second function being effected upon depression of the SHIFT key 209 and the respective key. In addition, a third function is printed below a number of the keys, the third function being effected by depression of this key along with the SHIFT key (only in the event that depression of the key for effecting the second function would have not have resulted in a valid entry). If depression of a key for performing a primary function would have been invalid, such depression causes the selection of the second function, without depression of the SHIFT key, if the respective second function constitutes a valid response to a prompt at that time.

As is apparent in FIG. 3, the second functions of a number of the keys correspond to the letters A–Z. The second functions of the keys of the first row of the group 300, however, are commands for the printing of various reports, such as UPS, a miscellaneous carrier, or a carrier to be selected from a menu. The first key in the second row of group 300 may direct the system to count parcels of the same weight, the second key in this row may enable manual entry of the weight, and the third key in this row allows entry of weight from a remote scale.

Figure 4:
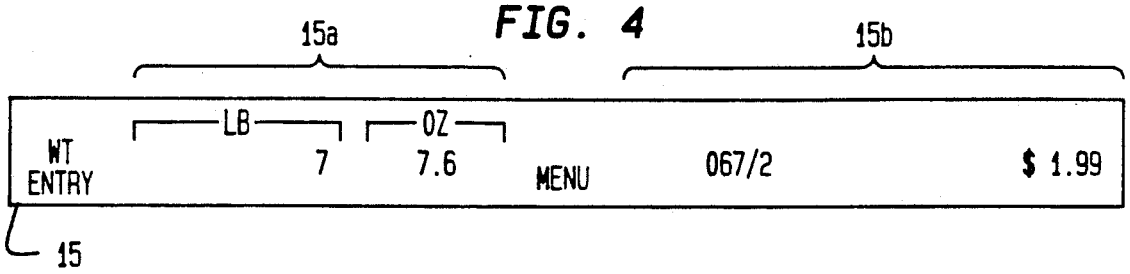
FIG. 4 is an illustration of the display of the system of FIG. 1.

FIG. 4 illustrates a display 15 that may be employed in the carrier management system of the invention. As illustrated, the display includes a section **15*a* that displays the weight of a parcel on the platform, for example in pounds and ounces. The other portion 15*b* of the display is employed for various alphanumeric messages. These messages may include various menus and lists of choices (that may be scrolled by the user), responses given by the user such as the zip code and zone messages shown in the figure, as well as prompts, etc., as well as, at the right end of the portion 15*b***, the shipment cost that has been calculated by the system.

In use of the above described system, i.e. not considering the specific features of the present invention, a parcel is placed upon the platform 13, and, in response thereto, a message is displayed prompting the user to enter an identification number of the parcel. When an identification number has been entered, the user may be optionally prompted to enter user definable, customer related information associated with the parcel to be shipped, as well as remarks concerning the parcel. Next the user is prompted to enter a carrier/class selection. In response thereto, the user depresses one of the keys of row 101 of keyboard section 100, if the parcel is to be shipped by USPS, or one of the keys of row 102 of keyboard section 100 if the parcel is to be shipped by UPS. The separate keys of these two rows correspond to different classes of service. Some of these keys may correspond to more than one class of service, in which case a menu is displayed and scrolled on the display to permit the operator to select the desired class of service. For example, the first key in row 101 may enable the user to select either first class or priority USPS mail service, and the second key in this row may enable the user to select either third or fourth class USPS mail service. Following this selection, the user is prompted to enter the Zip code, in response to which the user enters a 3 digit zip code (i.e. the most significant 3 digits of the Zip code). The system now displays the weight of the parcel at the section 15*a* of the display, the 3 digit Zip code and Zone at the section 15*b* of the display, and the shipping charges at the section 15*b* of the display.

If desired, the user may now depress one or more of the special charge keys in the section 201 of the keyboard. For example, if the parcel is oversize, the first key in the first row of this section is depressed, following which the display shows the additional charges for an oversize parcel. After a predetermined time, the display will show the total charges for shipping the parcel including the oversize parcel charges. The other special charge keys function in a similar manner to add charges for other special services.

At this time, if the user is satisfied with the entries that have been made, the print key 302 is depressed and the parcel is removed from the platform, to complete the transaction. The system now proceeds to print any desired documents, tags, tapes or labels, and, if the program requires, to perform any necessary accounting functions.

As discussed above with reference to FIG. 2, the system includes a replaceable board 16 that has a PROM 31 thereon. This board is placed in a location, for example under the scale platform, that renders its replacement somewhat difficult, to inhibit its manipulation by unauthorized personnel. The PROM 31 may have stored therein information that identifies the user of the system, as well as the zip code of the physical location of the system, this data being employed in the program of the system as stored in memory 21. The system also includes an NVM 27 which may be employed as an accounting register, for example in the manner employed in a postage meter, when an accounting routine in the program memory 21 is activated.

In addition, a service board or service PROM 36 is releasably mounted in the system along with the user PROM. The service PROM 36 may include authorization data enabling the accounting registers of the system, as well as the accounting program. In addition, the service PROM encorporates data enabling the setting or resetting of the accounting registers in the battery backed up RAM 26.

Figure 5:
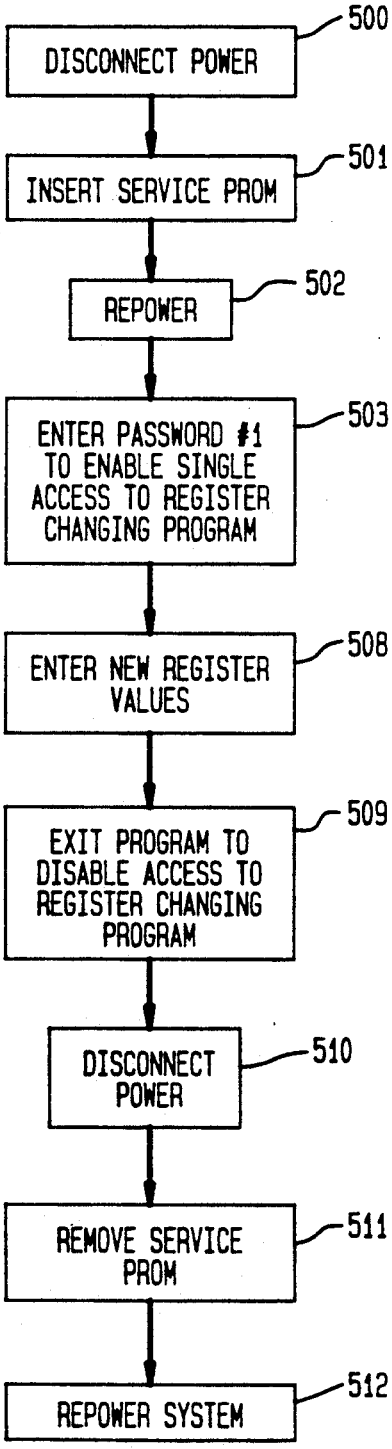
FIG. 5 is a flow diagram illustrating use of the service PROM in enabling a register setting program.
Figure 6:
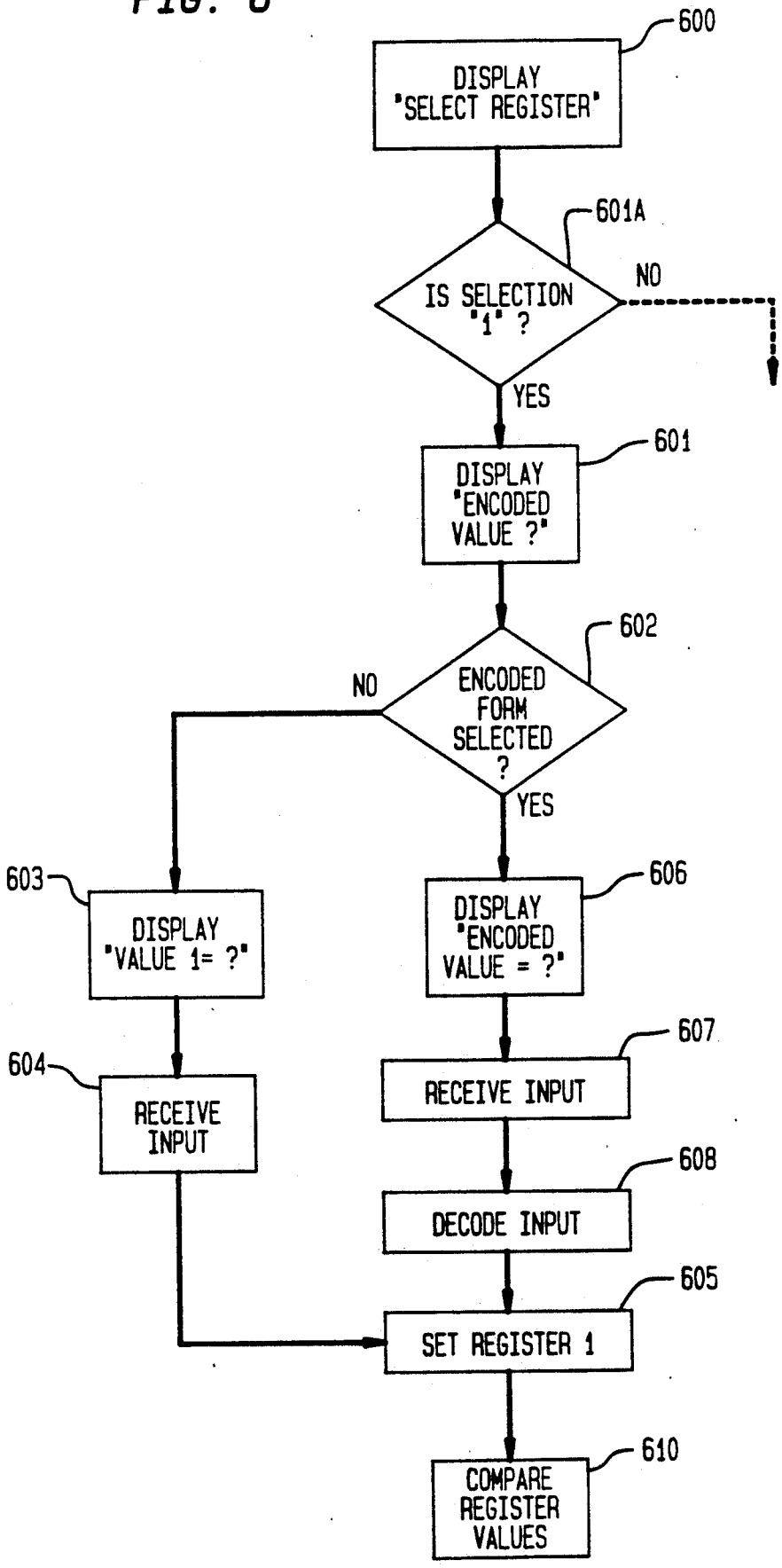
FIG. 6 is a flow diagram illustrating a register setting program.

The functions and use of the service PROM 36 will be more clearly understood with reference to the flow diagram of FIGS. 5 and 6. FIG. 5 illustrates one procedure for employing the service PROM to enable a program in the program memory 21 that sets the accounting registers. As illustrated at block 500, in order to enable insertion of the service PROM it is first necessary to remove power from the system. Then, as indicated at block 501, the service PROM is inserted in a separate socket in the system. In a alternative arrangement, the user PROM 31 could be replaced by the service PROM. Power is again applied to the system at block 502. In one arrangement, the control of the service PROM is not effective until the user enters a predetermined password in the keyboard of the system, at block 503. This step may be eliminated, if desired, by providing the system program with a subroutine that automatically enables the functions of the service PROM to be activated if the PROM is physically present in the system. The password, if one is necessary, enables keyboard entries in the system to access the register changing program in the memory 21 a single time. The service PROM may thus have coded data therein that is recognized by the program to permit a single resetting procedure. The password may call up a menu to access other features of the system, or if no password is necessary, the repowering of the system, with the service PROM present, may call up such a menu. The service PROM may also have coded data therein to enable accounting programs in the program, and to enable use of the accounting registers, so that the system can internally account for transactions.

After the user has entered any necessary password, and performed any other steps, such as responding to menu entries on the display 15 to enable the register setting program, the desired register values are entered in the keyboard as indicated at block 508. Exit from the setting routine, at block 509, effects the setting of the registers to the value entered in the keyboard, and disables any further access to the setting program until once again authorized by the above procedure. The power may be now disconnected, at block 510, and the service PROM removed at block 511. The system may now be repowered, at block 512, for normal operation.

If the service PROM had been employed to temporarily replace the customer PROM, the customer PROM is of course reinserted in its socket prior to repowering the system.

FIG. 6 is a flow diagram of a program that may be employed in accordance with the invention, for setting the accounting registers. This program is called by the entering of a password, at block 503 in the flow diagram of FIG. 5. Referring now to FIG. 6, if the accounting registers include more than one register, such as an ascending register and a descending register, a prompt on the display requests a response of which register is to be reset, at block 600. The figure refers to the two registers as register "1" and register "2", for example corresponding to the ascending and descending registers. If register 1 is selected, a prompt is given at block 601 for the user to enter a response indicating whether the desired register value will be entered in coded form or in uncoded form. As will be seen, this selection provides the advantage that service personnel can enter an uncoded register value directly in the system, or a coded value from a tape generated by the system can be employed for register setting. If the response indicates an uncoded value will be entered, at block 602, the system prompts the user to enter the uncoded value, at block 603. The user then enters the uncoded register value at block 604, and the system sets the register "1" at block 605.

If the user has indicated that an encoded value was to be entered, at block 602, a prompt is given at block 606 for entry of the coded value. The desired value is entered at block 607, and the system decodes the entered value at block 608 and sets the register "1" in accordance with the decoded value, at block 605. The decoding is effected in accordance with a predetermined algorithm.

A similar procedure is provided for setting the desired value in register "2", if such a register is provided, and hence a detailed description of the resetting of this register is not necessary. As a final step in the program, before exiting the program at block 509 of FIG. 5, the program may compare the values of the settings of the two registers, at block 610, to determine if the settings of the register correspond to permissible values, e.g. if the sum thereof is equal to a control sum value stored elsewhere in the system. If the values are not permissible, the program may go into a fault routine (not illustrated), for example to permit the service person to enter different values.

Figure 7:
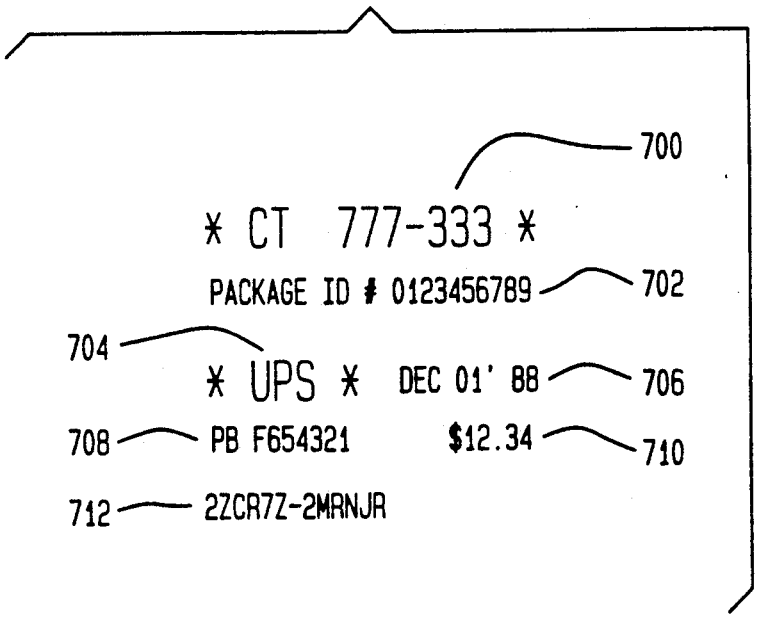
FIG. 7 is an illustration of a tape that may be printed by the system, enabling the resetting of the registers to the proper value.

In the initial set up of the system, the service person may be supplied with predetermined values for entry into the registers. If resetting is required after a fault has occurred in the system, however, such predetermined values are of no use, since their introduction would result in loss of accounting records. Accordingly, in accordance with the invention, a printer 24 of the system is controlled to print a tape, at each transaction, including thereon various information concerning the transaction. Such a tape is illustrated, for example, in FIG. 7. The tape includes, for example, the transaction identification 700, the parcel number 702, the carrier identification 704, the date 706, the identification 708 of the system, and the amount 710 of the transaction. In addition, the tape is printed to include coded representations 712 of the register values at the end of the transaction. These values are meaningless to the user and the carrier. The values on the last tape before a malfunction of the system may be employed, however, by the service person to reset the values of the register, thereby preventing loss of accounting information. The algorithm for deriving the values 712 is of course selected so that the values are properly decoded at the decoding step 608 as illustrated in FIG. 6. It is of course apparent that the coded register values may be printed on other documents of the system, such as manifests, labels, etc.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. In a carrier management system including a scale for weighing parcels to be shipped, a computer connected to receive data from said scale related to the weight of a parcel thereon, and a keyboard enabling operator input to said computer, the improvement wherein said computer comprises an accounting register, said computer having a program for resetting said register, said system further comprising service memory means, means for releasably coupling said service memory means to said system, said system comprising means responsive to coupling of said service memory to said system for enabling said resetting program.

2. The carrier management system of claim 1 wherein said program comprises means for receiving encoded values from said keyboard and means for decoding said encoded values for storing in said register, and further comprising printing means connected to said computer for printing said encoded values.

3. In a carrier management system including a scale for weighting parcels to be shipped and determining shipping costs thereof, a computer connected to receive data from said scale related to the weight of a parcel thereon, a keyboard enabling operator input to said computer, and printing means, said printing means being coupled to said computer, whereby each process of weighting a parcel and determining the shipping costs thereof comprises a transaction, the improvement wherein the computer has a memory with a register for storing accounting data related to the shipping of parcels, said computer comprising means for actuating said printing means to print for every transaction a coded value representing a current reading of said register, said computer having a program responsive to said coded value being input into said keyboard for decoding said coded value for resetting said register, said system further comprising service memory means, means for releasably coupling said service memory means to said system, said system comprising means responsive to coupling of said service memory to said system for enabling said resetting program.

4. The carrier management system of claim 3 wherein said service memory means comprises a PROM releasably coupled to said system.

5. The carrier management system of claim 4 wherein said scale has a platform, and said PROM is located under said platform.

6. In a carrier management system including at least one resettable register for storing accounting data related to transactions handled by the system, and a printer for printing data related to said transactions, a method of resetting said register after a malfunction of said system, the method comprising the steps of:

(a) printing coded register values prior to said malfunction;

(b) after said malfunction, coupling a service memory means to said system in order to enable a register resetting routine; and (c) entering said printed values after enabling said register resetting routine.

7. The method of claim 6, wherein said printing step comprises said printer printing said coded values on a tape.

8. The method of claim 6, wherein said printing step comprises said printer printing said coded values on a label.

9. The method of claim 6, further comprising the step of indicating that coded values are to be entered before said entering step.

* * * * *